US006131819A

United States Patent [19]

Fuller et al.

[11] Patent Number: 6,131,819

[45] Date of Patent: Oct. 17, 2000

[54] DECORATIVE ILLUMINATED WATER DISPLAY

[75] Inventors: Mark W. Fuller, North Hollywood; John Canavan; James Doyle, both of Burbank; Keith Kalis, Lancaster; Terry Van Blaricom, Sherman Oaks, all of Calif.

[73] Assignee: WET Enterprises, Inc., Universal City, Calif.

[21] Appl. No.: 09/174,368

[22] Filed: Oct. 15, 1998

[51] Int. Cl.[7] ..... F21P 7/00

[52] U.S. Cl. ..... 239/20; 239/587.6

[58] Field of Search ..... 239/586.1, 587.6, 239/18, 16, 17, 20

[56] References Cited

U.S. PATENT DOCUMENTS

| | | | |
|---|---|---|---|
| 1,880,272 | 10/1932 | Panther | 239/587.2 X |
| 2,561,432 | 7/1951 | Tranter | 239/587.1 |
| 2,698,664 | 1/1955 | Freeman | 239/587.2 X |
| 2,984,422 | 5/1961 | Wogt et al. | 239/45 X |
| 3,003,312 | 10/1961 | Jewell . | |
| 3,770,062 | 11/1973 | Riggs | 239/587.1 X |
| 3,989,109 | 11/1976 | Gagliardo | 239/587.2 X |
| 4,007,793 | 2/1977 | Hux et al. | 239/587.2 X |

FOREIGN PATENT DOCUMENTS

| | | |
|---|---|---|
| 219159 | 8/1992 | Japan . |

*Primary Examiner*—Kevin Weldon

*Attorney, Agent, or Firm*—Blakely, Sokoloff, Taylor & Zafman LLP

[57] ABSTRACT

The present invention relates to a decorative water display having many degrees of freedom. The water display has one or more water display nozzles mounted so that the direction of the nozzle may be controlled such as by a computer. In the preferred embodiment, the pressure of the water delivered to the nozzle may also be controlled as desired. Also controllable with the nozzle direction is appropriate lighting to illuminate the discharge from the nozzle for night time use. The elevation of the entire assembly is controllable, preferably between an operative position, a withdrawn position totally below the water surface and a service position extending above the water surface. Various embodiments and features are disclosed.

75 Claims, 10 Drawing Sheets

COMPUTER
ELECTRICAL SUPPLY
AIR SUPPLY

DECORATIVE ILLUMINATED WATER DISPLAY

BACKGROUND OF THE INVENTION

1. Field of the Invention

The present invention relates generally to water displays, and more particularly to water displays that permit control over the movement of a nozzle and associated lighting.

2. Prior Art

Water displays of increasing sophistication and complexity are being more frequently installed as decorative attractions around commercial buildings and complexes of various kinds. Many such water displays include a body of water in the form of a pool or small lake in which various individual water displays or features are placed. Individual water displays in such installations may take various forms, though the more variation that may be provided in any individual water display, typically under computer control, the greater the public interest in the attraction. Also, operation of such displays at night usually enhances the visual effect of such displays, provided the display can be properly and interestingly lighted to achieve the desired result.

BRIEF SUMMARY OF THE INVENTION

The present invention relates to a decorative water display having many degrees of freedom. The water display has one or more water display nozzles mounted so that the direction of the nozzle may be controlled such as by a computer. In the preferred embodiment, the pressure of the water delivered to the nozzle may also be controlled as desired. Also controllable with the nozzle direction is appropriate lighting to illuminate the discharge from the nozzle for night time use. The elevation of the entire assembly is controllable, preferably between an operative position, a withdrawn position totally below the water surface and a service position extending above the water surface. Various embodiments and features are disclosed.

DETAILED DESCRIPTION OF THE INVENTION

For purposes of explanation, specific embodiments are set forth to provide a thorough understanding of the present invention. However, it will be understood by one skilled in the art from reading this disclosure that the invention may be practiced without these details. Moreover, well-known elements, devices, process steps and the like are not set forth in detail in order to avoid obscuring the invention.

Figure 1:
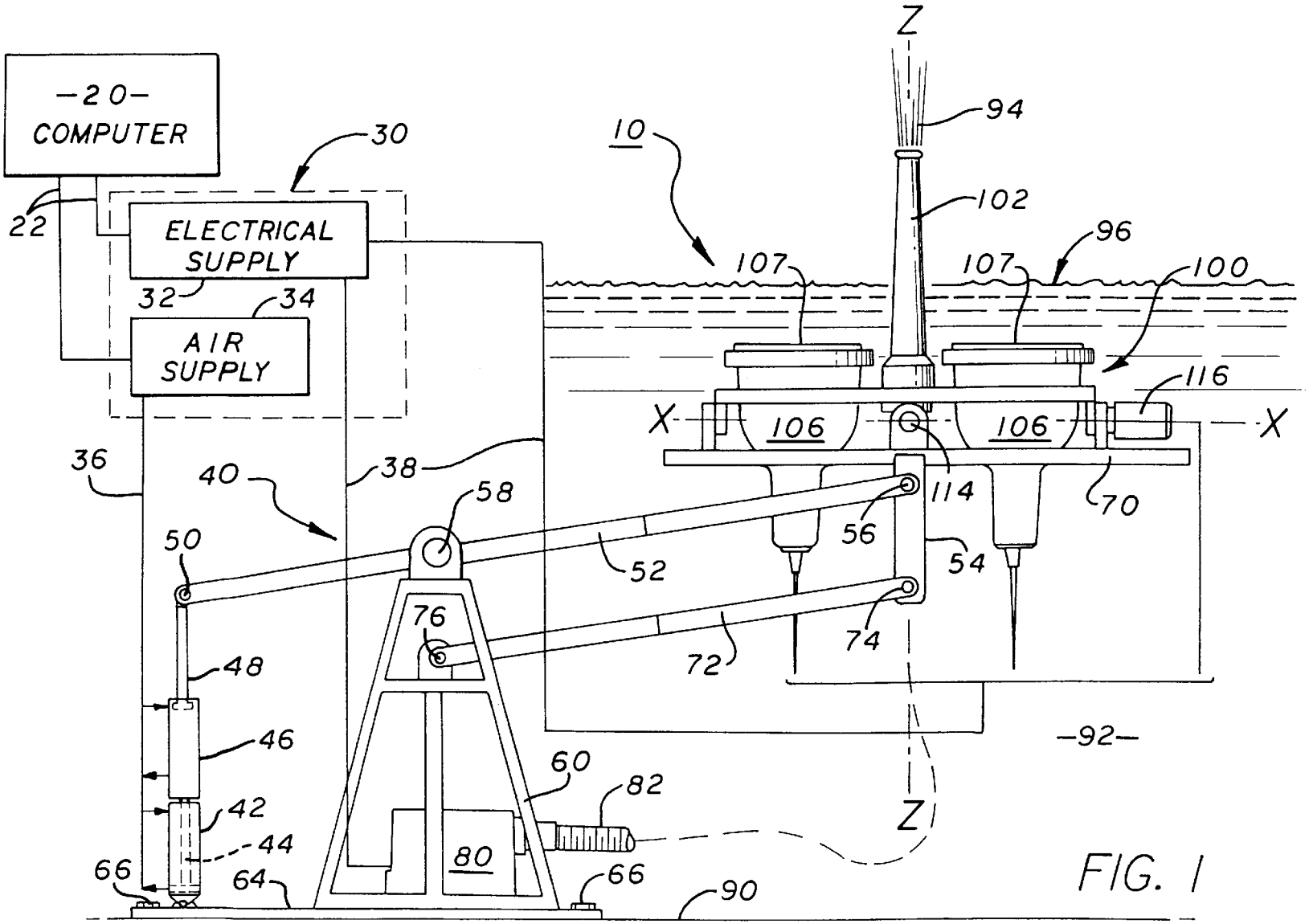
FIG. 1 is a side view of a water display in the operative position.

Reference is now made to FIGS. 1 through 12 to illustrate the embodiments of the invention. FIG. 1 is a side view of a typical water display 10 in accordance with the present invention in the operative or performance position. Water display 10 may be comprised of computer 20, auxiliary services 30, linkage 40, pump 80 and gimbal assembly 100. Computer 20 operates to control the supply of auxiliary services 30 to the remainder of water display 10. In the embodiment shown, the remainder of water display 10 makes use of electrical supply 32 and air supply 34, each having communications links 22 from computer 20. Other services such as fuel (for inclusion of flame in the water display), fire color agents, ignitor, light beam coloring wheels and the like may be included in the auxiliary services 30 as desired. Communication links 22 may be a direct link through cabling, or an indirect link through known methods.

Figure 4:
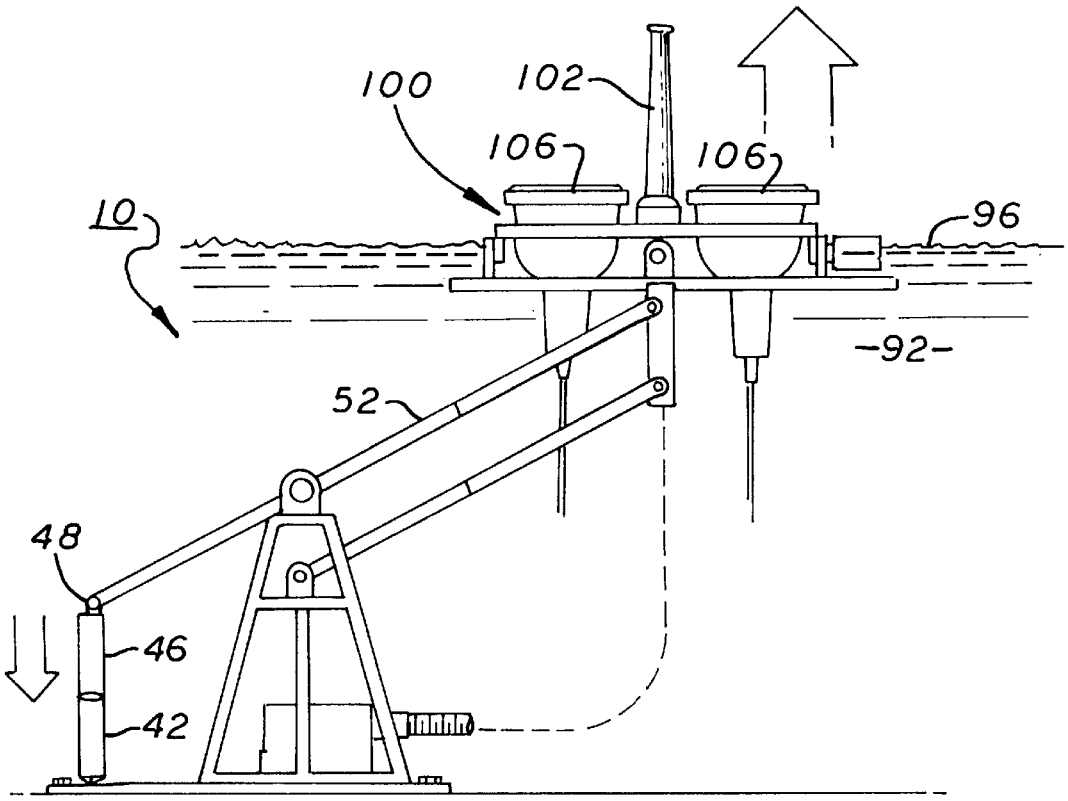
FIG. 4 is a side view that shows the gimbal moved to the service position.
Figure 5:
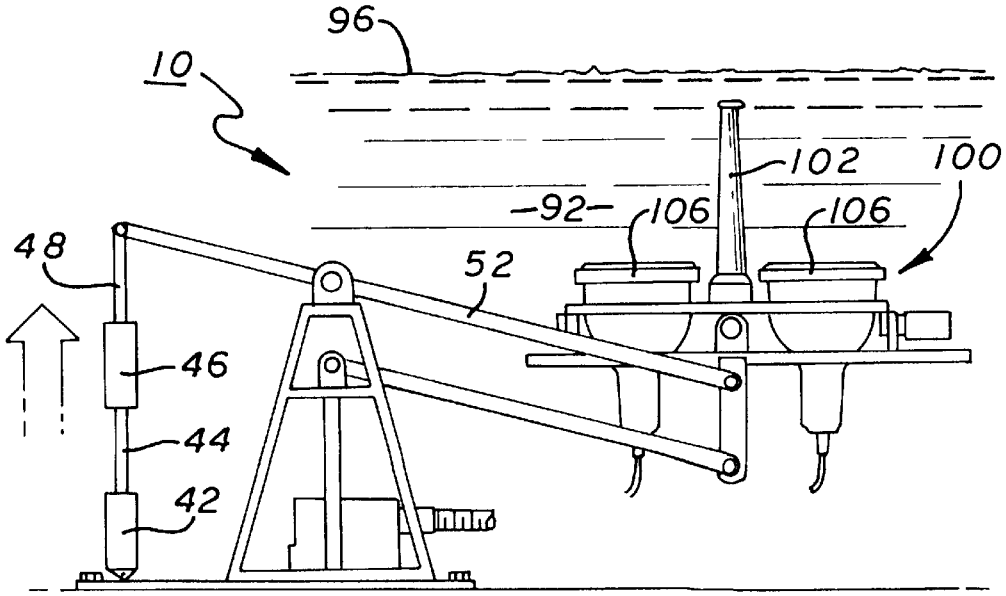
FIG. 5 is a side view that shows the gimbal moved to the withdrawn or park position.

Air supply 34 may be used to supply the force needed to position gimbal assembly 100 in three vertical positions: the operative or performance position (seen in FIG. 1), the service position (seen in FIG. 4), and the park position (seen in FIG. 5). This force may be first transmitted to linkage 40 through fluid lines 36 and then converted into motion by linkage 40. By transmitting this controlled motion to gimbal assembly 100 through linkage 40, gimbal assembly 100 may be positioned into one of its three vertical positions.

As shown in FIG. 1, linkage 40 may be a system of interconnected machine elements, such as cylinders, pistons, pivots, and yokes, used to transmit motion to gimbal assembly 100. In the preferred embodiment, linkage 44 may be comprised of cylinder 42, piston 44, cylinder 46, piston 48, pin 50, positioning yoke 52, platform link 54, pins 56, fulcrum 58, frame 60, base 64, bolts 66, support frame 70, stabilizing yoke 72, pins 74, and pin 76.

Air supply 34 may be connected to both cylinder 42 and cylinder 46 of linkage 40 through the appropriate number of fluid lines, schematically represented by fluid lines 36. To move positioning yoke 52, each cylinder has a piston that may be responsive to air from air supply 34. Piston 44 operates with cylinder 42 and piston 48 operates with cylinder 46. Piston 44 is shown in FIG. 1 under fluid pressure from air supply 34 so as to raise gimbal assembly 100 to the performance position. Piston 48 is shown in FIG. 1 not under fluid pressure from air supply 34, thus maintaining gimbal assembly 100 in the performance position. Note that the supply from air supply 34 may be any service that imparts force to move piston 44 and piston 48, such as air or water. Of course other types of actuators and/or linkages may be used for this purpose as desired. To transmit the vertical motion of piston 48 and piston 44 to gimbal assembly 100, piston 48 may be coupled to positioning yoke 52 through pin 50. In turn, positioning yoke 52 may be coupled to gimbal assembly 100 through platform link 54 at pins 56. To permit raising gimbal assembly 100 in response to lowering one or both of piston 44 and piston 48, positioning yoke 52 may be coupled to fulcrum 58.

Frame 60 provides support for fulcrum 58. Base 64 of FIG. 1 serves as a stable platform on which frame 60, cylinder 42, and pump 80 may be attached. Base 64 may be fixed to pool bottom 90 through, for example, bolts 66. For added control to water display 10, alternatively base 64 may be placed upon a computer controlled, motor driven wheeled platform on rails, that serves as a stable platform on which frame 60, performance cylinder 42, and pump 80 may be attached.

Support frame 70 is supported by platform link 54 at pins 56 and 74, and serves as a raised platform on which performances of water stream 94 are presented. To accurately control the movement of water stream 94, it may be important that support frame 70 maintain its known orientation. With pin 76 fixed to frame 60 at a point vertically below fulcrum 58, stabilizing yoke 72 rotates about pin 76 as positioning yoke 52 rotates about fulcrum 58 so as to maintain the known orientation of platform link 54, and thereby maintain the known orientation of support frame 70.

As seen in FIG. 1, pump 80 may be coupled to nozzle 102 through flexible hose 82. Preferably, pump 80 may be a variable frequency pump so that the velocity (pressure) of the water flow through nozzle 102 may be controlled by computer 20 through the power supplied from electrical supply 32 to pump 80. Pump 80 is shown in FIG. 1 as a submersible pump residing in a low-lying place within water 92 as attached to base 64. This may be preferable since residing in a low-lying place within water 92 permits pump 80 to be positioned close to the water display and to directly draw from and be cooled by water 92. In small scale installations, pump 80 may conveniently be placed in a dry room near electrical supply 32 and air supply 34.

Figure 2:
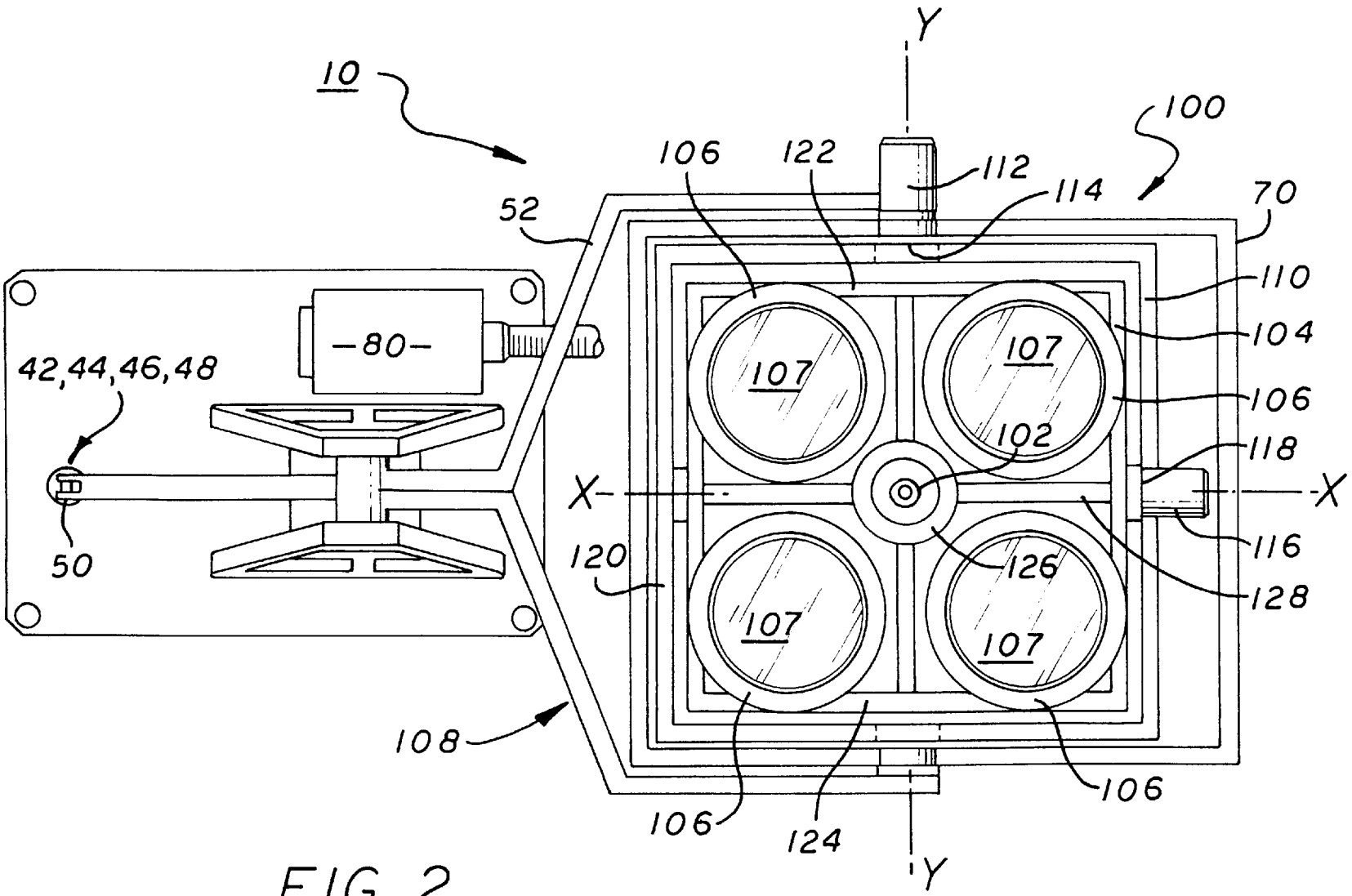
FIG. 2 is a plan view of the water display of the present invention.

FIG. 2 is a plan view of water display 10 of the present invention. Gimbal assembly 100 of water display 10 comprises inner gimbal 104, roll motor 116, outer gimbal 110, pitch motor 112, nozzle 102, lamps 106 each having a lens 107, and associated structure. Gimbal assembly 100 allows the controllable deflection of nozzle 102 from a vertical orientation about either or combinations of both of two orthogonal horizontal axes (e.g., the X and Y-axis).

As discussed above in connection with FIG. 1, support frame 70 not only contributes to the transfer of motion of piston 44 of FIG. 1 and piston 48 to gimbal assembly 100, but serves as a raised platform from which performances of water stream 94 are presented. Outer gimbal 110 of FIG. 2 may be rotationally coupled to support frame 70 through pitch axis 114, and inner gimbal 104 may be rotationally coupled to outer gimbal 110 through roll axis 118. In the preferred embodiment, pitch axis 114 and roll axis 118 are coplanar and located below the elevation of lens 107. However, the vertical distance between each lens 107 and each axis may be selected so that the amount of swing of gimbal assembly 100 through water 92 may be minimized. This will provide a faster response time for gimbal assembly 100 to the computer controlled pitch motor 112 and roll motor 116.

Preferably, inner gimbal 104 may be a quadrilateral such as a square, although other shapes such as round, oblong, or rectangular would work just as well. Within inner gimbal 104 may be an arrangement of objects. The arrangement of one lamp 106 at each corner of inner gimbal 104 and nozzle 102 at the center of inner gimbal 104 forms assembly 108. Preferably, gimbal assembly 100 consists of inner gimbal 104 and outer gimbal 110 mounted on axes at right angles to each other so that assembly 108 will remain suspended in a computer controlled plane in response to any motion of either or both gimbals. In the plan view of FIG. 2, inner gimbal 104, outer gimbal 110, and support frame 70 are concentric to one another.

To drive each gimbal of gimbal assembly 100, motors powered by electrical supply 32 of FIG. 1 through electrical lines 38 are provided. Preferably, these motors are sealed electrical servo motors, although water based hydraulic motor systems or other drive systems may be used. Pitch motor 112 of FIG. 2 may be coupled to outer gimbal 110 through pitch axis 114. Roll motor 116 may be coupled to inner gimbal 104 through roll axis 118. Through pitch axis 114, pitch motor 112 works on outer gimbal 110 to cause outer gimbal 110 to rotate about lateral axis Y—Y so that roll motor 116 lifts or descends in relation to tail portion 120 of outer gimbal 110. Roll motor 116 works on inner gimbal 104 to cause inner gimbal 104 to rotate about longitudinal axis X—X so that port side 122 of inner gimbal 104 lifts or descends in relation to starboard side 124 of inner gimbal 104 as viewed from the left side of FIG. 2. To make nozzle 102 responsive to the motion of either inner gimbal 104 or outer gimbal 110 of gimbal assembly 100, nozzle 102 may is secured to support plate 126, where support plate 126 has spokes 128 that connect support plate 126 to inner gimbal 104.

Figure 3:
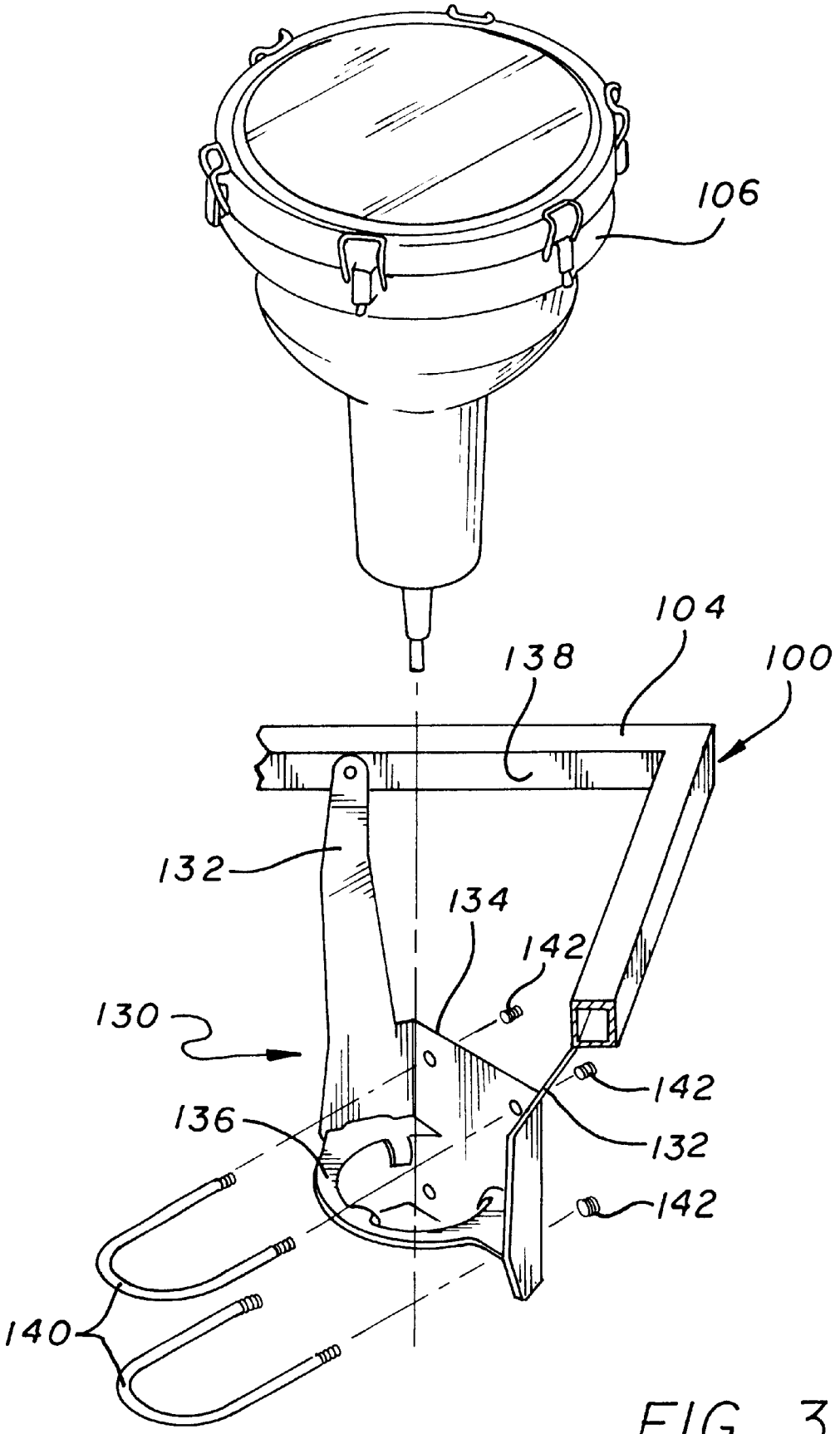
FIG. 3 is an exploded perspective view of the installation of a lamp into the gimbal.

FIG. 3 is an exploded perspective view of the installation of lamp 106 into gimbal assembly 100. Preferably, each of the four lamps 106 shown in FIG. 2 are as close to nozzle 102 as reasonably possible so that the beams of light from each lamp 106 will follow the stream of water 94 of FIG. 1. Yoke seat 130 of FIG. 3 comprises two upright arms 132 linked by back support 134. Ring 136 may be attached to back support 134 to form a seat for lamp 106. As shown for one inside corner of inner gimbal 104 and may be true for each inside corner of inner gimbal 104, yoke seat 130 may be attached to inside corner 138 of inner gimbal 104 by the two upright arms 132. On placing lamp 106 into ring 136 of yoke seat 130, two U-shaped bolts 140 are inserted around the base of lamp 106 and through back support 134 to be secured by nuts 142.

As previously described, air supply 34 of FIG. 1 may be used to supply the force needed to position gimbal assembly 100 in any one of three vertical positions: the performance position (seen in FIG. 1), the service position (seen in FIG. 4), and the park position (seen in FIG. 5). In operation, a control signal may be provided by computer 20 of FIG. 1 to air supply 34 that directs air supply 34 to pump air into the upper portion of cylinder 42, thereby forcing piston 44 down. Forcing piston 44 down, in turn, pulls down positioning yoke 52 at pin 50. Positioning yoke 52 responds by pivoting about fulcrum 58 to raise gimbal assembly 100 to the performance position shown in FIG. 1. In the performance position, nozzle 102 in the preferred embodiment, being approximately eighteen inches in length, extends above water surface 96 by approximately twelve inches. In this embodiment, preferably each lens 107 of the four lamps 106 are mounted on gimbal assembly 100 so that lenses 107 may be approximately six inches below water surface 96 in the performance position when the nozzle is vertical.

FIG. 4 is a side view showing gimbal assembly 100 moved to the service position. When air pressure is provided to the upper portion of cylinder 46, piston 48 may be forced down from its uncharged position shown in FIG. 1 to a position shown in FIG. 4 so as to fulcrum gimbal assembly 100 to a position that may be substantially higher than the performance position shown in FIG. 1. This substantially higher position of FIG. 4 places the majority of gimbal assembly 100 above water surface 96 for ease of servicing. When the servicing is finished, air may be bled from the upper portion of cylinder 42 and cylinder 46. Without the force of air driving the pistons of each cylinder down, gravity sinks heavier-than-water gimbal assembly 100 below water surface 96 to the park position shown in FIG. 5. Alternatively, air from air supply 34 of FIG. 1 may be forced into the lower portion of each piston to drive each piston up, thereby causing gimbal assembly 100 to fulcrum below water surface 96 to the park position shown in FIG. 5. In the park position, the entire water display 10, including nozzle 102 of gimbal assembly 100, may be covered by water 92 so as not to be visible.

Figure 6:
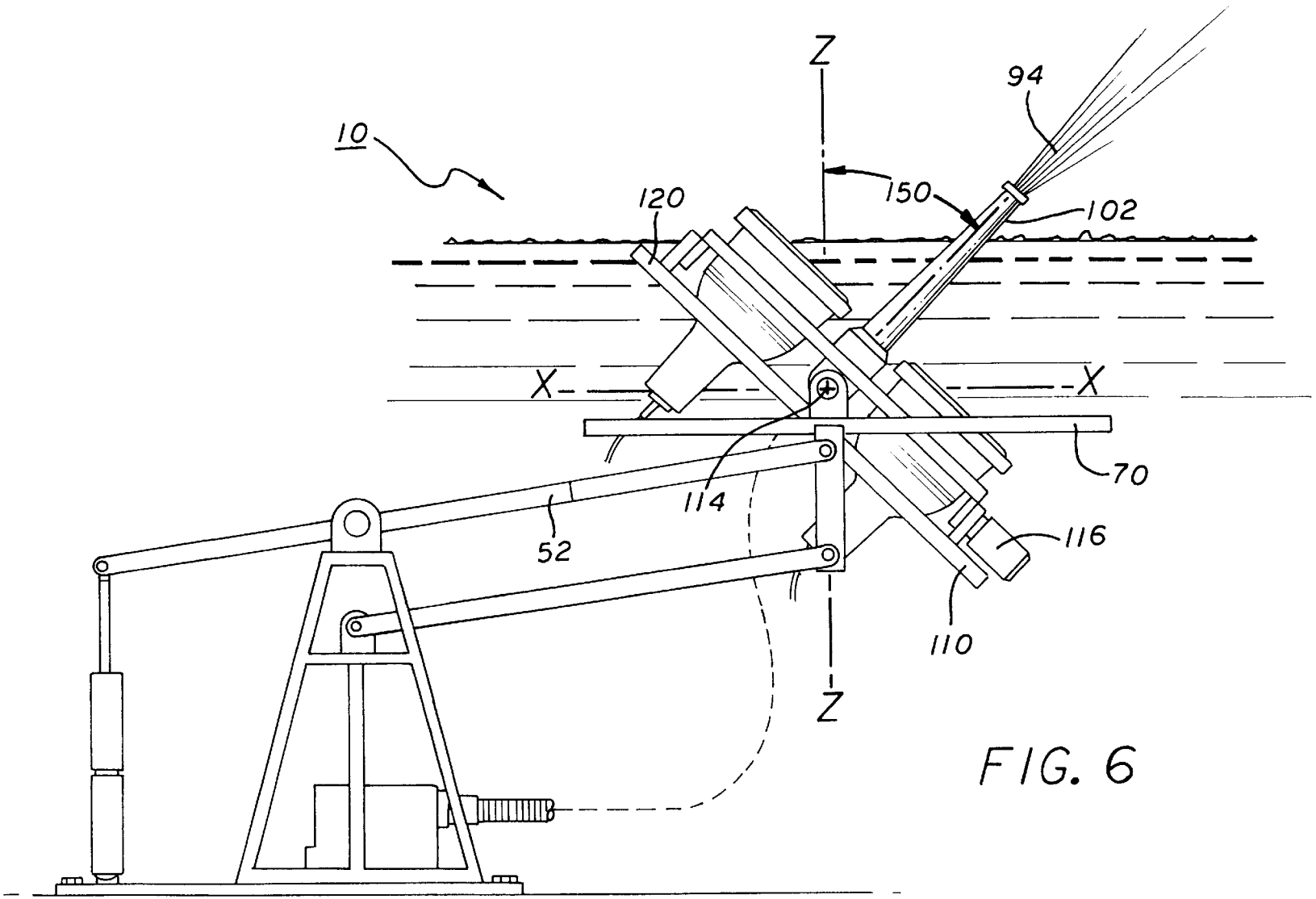
FIG. 6 is a side view of the water display.
Figure 7:
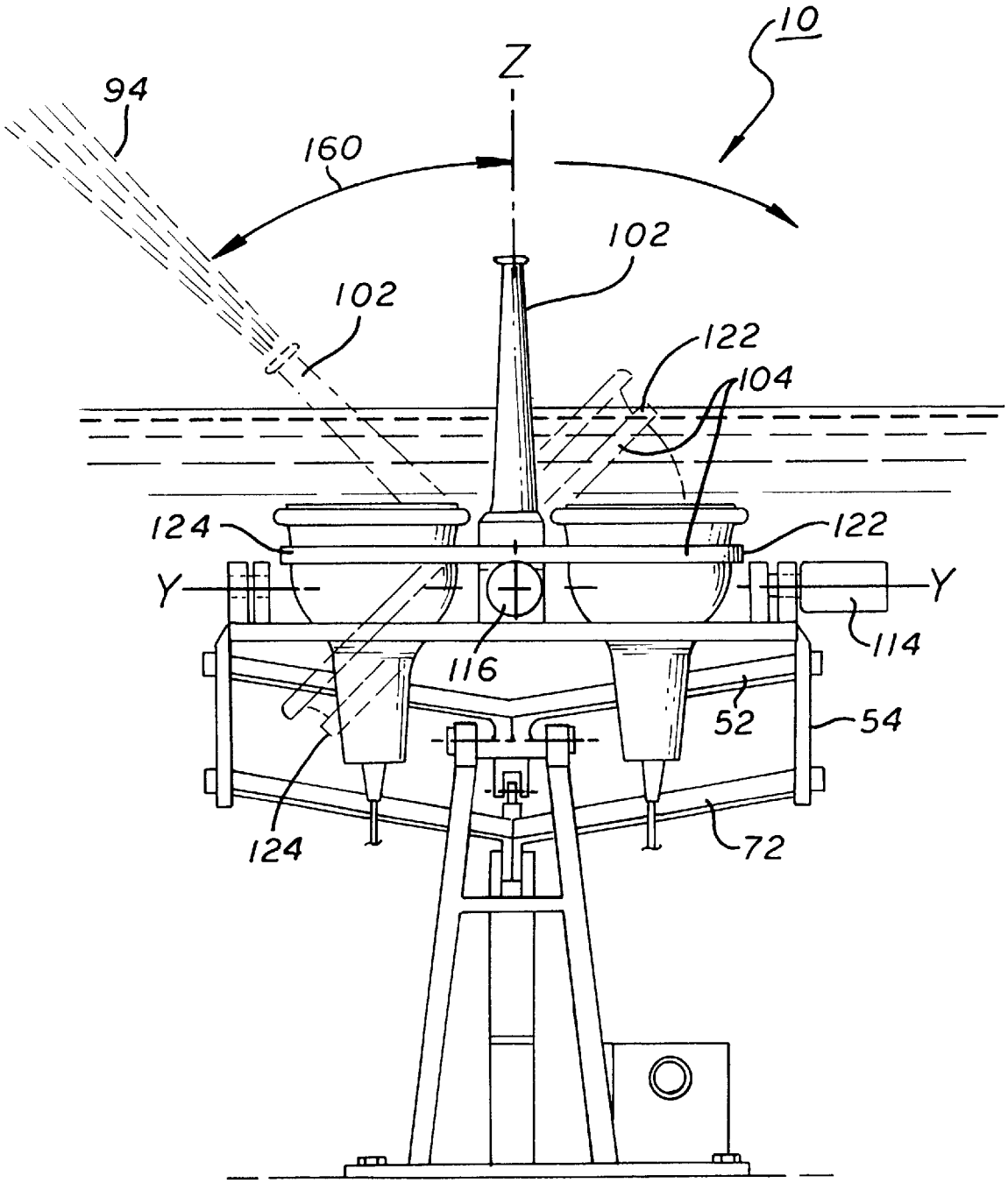
FIG. 7 is a front view of the water display.

From the performance position shown in FIG. 1, gimbal assembly 100 permits controlled movement of nozzle 102 from its vertical orientation in a pitch direction, as shown in FIG. 6, and a roll direction, as shown in FIG. 7.

FIG. 6 is a side view of water display 10 showing nozzle 102 pitched forward. In response to a control signal as generated by computer 20, pitch motor 112 (shown in FIG. 2) works on outer gimbal 110 of FIG. 6 through pitch axis 114 to cause outer gimbal 110 to rotate about pitch axis 114 by an amount proportional to the control signal so that as roll motor 116 descends in relation to tail portion 120. This, in turn, pitches water display forward so that the stream 94 and light beams of water display may be directed at angle 150 relative to the Z-axis. Water stream 94 may also be pitched in the opposite direction at the same rotation as angle 150. In one embodiment, nozzle 102 will rotate plus or minus sixty degrees (±60°) about pitch axis 114.

FIG. 7 is a front view of water display 10 showing in phantom nozzle 102 rolled to starboard. On receiving a control signal generated by computer 20, roll motor 116 of FIG. 7 works on inner gimbal 104 through roll axis 118 (shown in FIG. 2) to cause inner gimbal 104 of FIG. 7 to rotate about roll axis 118 so that as starboard side 124 descends in relation to port side 122. This, in turn, rolls the water display starboard so that the stream of water 94 may be directed at angle 160 relative to the Z-axis. Water stream 94 may also be rolled in the opposite direction at the same rotation as angle 160. In one embodiment, nozzle 102 will rotate plus or minus forty five degrees (±45°) about roll axis 118. By combining the pitch movement as controlled through pitch motor 112 of FIG. 2, the roll movement as controlled through roll motor 116, and the variable water flow through nozzle 102 as controlled through pump 80, computer 20 of FIG. 1 can be used to specify completely the location of the stream of the water display and to manipulate the stream of water 94 into a most pleasing, expressive water display with the illumination thereof following the stream 94 from the nozzle 102.

Figure 8:
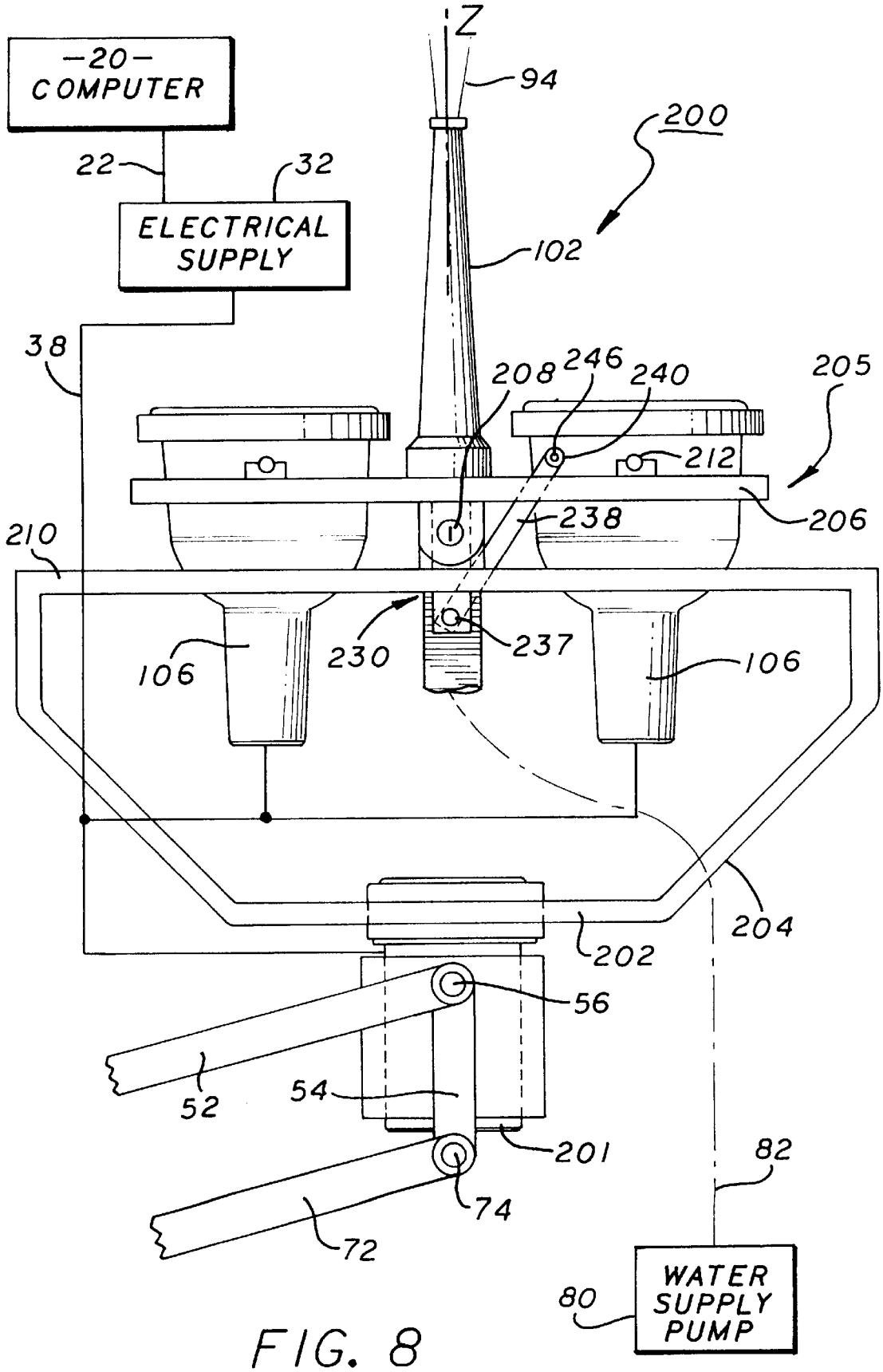
FIG. 8 is a side view of an alternate embodiment of the present invention.

The above embodiment controls movement of nozzle 102 in an X-Y-Z Cartesian coordinate system through a gimbal system comprising an inner gimbal and an outer gimbal mounted on axes at right angles to each other. An alternate embodiment may be used to control movement of nozzle 102 in an R-Ø-Z polar coordinate system through one gimbal mounted on a rotatable axis, the axis itself being rotatable about the Z-axis. FIG. 8 is a side view of such an alternate embodiment. Coupled between positioning yoke 52 and stabilizing yoke 72 by pins 56 and pins 74, respectively, may be platform link 54 of water display 200. Fixed to platform link 54 may be yaw motor 201. Preferably, yaw motor 201 is a servo motor capable of controllably rotating about the Z-axis in either direction. Coupled to yaw motor 201 may be frame 204 having bottom surface 202. On receiving a control signal from electrical supply 32 as generated by computer 20, yaw motor 201 will rotate frame 204 about the Z-axis.

Frame 204 may be coupled to gimbal assembly 205 through gimbal 206 at horizontal axis 208. As frame 204 is rotated about the Z-axis, gimbal 206 rotates about the Z-axis. Top surface 210 of frame 204 may be at a distance above bottom surface 202 of frame 204 to permit unencumbered movement of objects on platform 210. In the R-Ø-Z polar coordinate system of this embodiment, platform 204 rotates about the Z-axis in known orientations, permitting the use of only one gimbal, here gimbal 206, for full X-Y plane movement of the nozzle and lamps.

Figure 9:
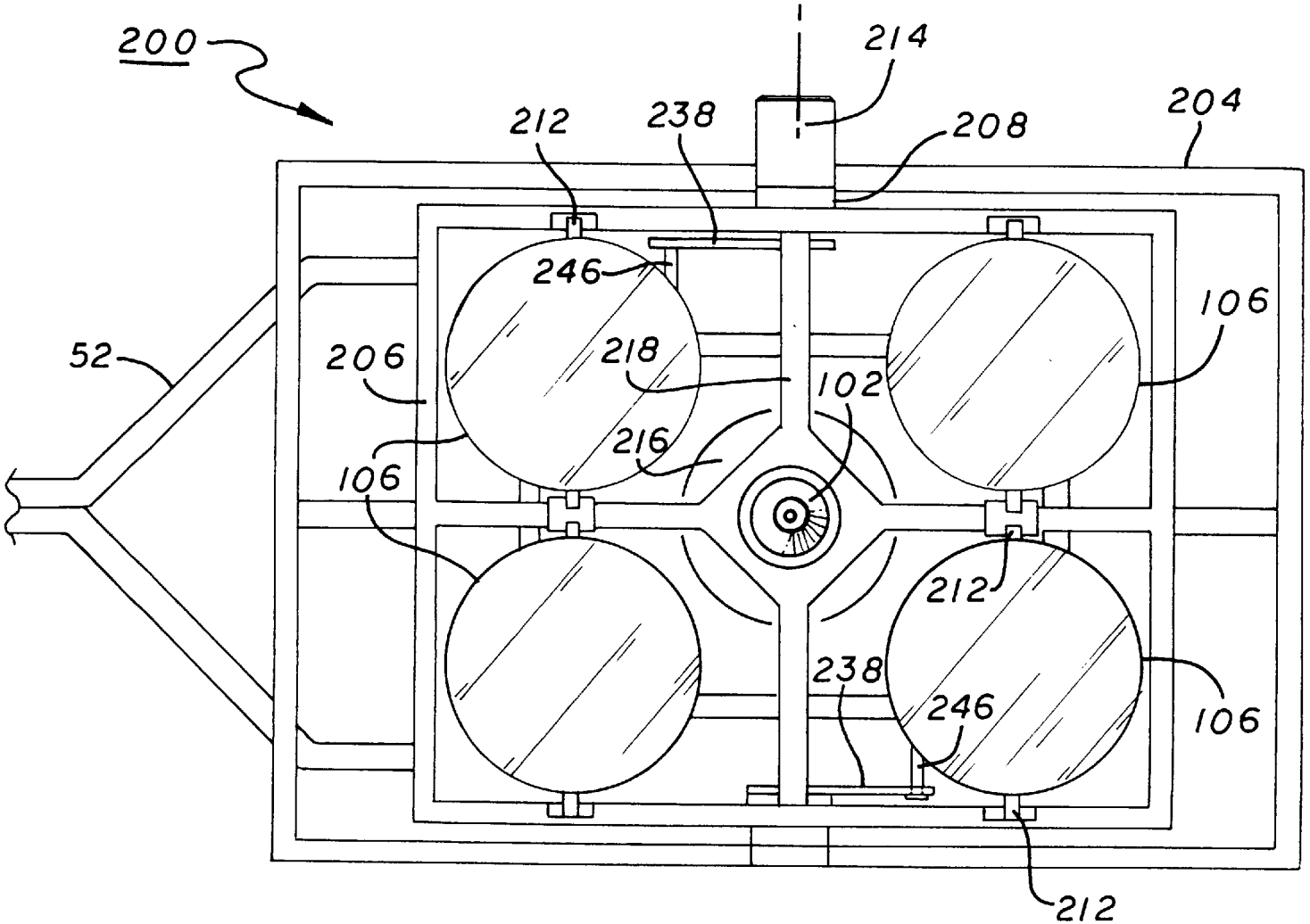
FIG. 9 is a top view of the alternate embodiment water display of FIG. 8.

FIG. 9 is a top view of the alternate embodiment water display 200. In this embodiment, preferably gimbal 206 is a quadrilateral such as a rectangle, although other shapes such as round, oblong, or square would work just as well. Within gimbal 206 may be an arrangement of lamps and at least one nozzle. As shown in FIG. 9, four lamps 106 are supported by gimbal 206. Two lamps, specifically diagonally disposed lamps in this embodiment, are rigidly attached to the gimbal, as is nozzle 102. The other two lamps are attached to the gimbal through pins 212 on an axis that is parallel to horizontal axis 208 of horizontal motor 214 and at a location that permits the respective lamps 106 to rotate relative to and without touching gimbal 206. In the plan view of FIG. 9, gimbal 206 and frame 204 are concentric to one another. To drive gimbal 206, horizontal motor 214, powered by electrical supply 32 of FIG. 8 through electrical lines 38, may be coupled to gimbal 206 through horizontal axis 208 to cause gimbal 206, two lamps and the nozzle to controllably and proportionally rotate about horizontal axis 208.

Figure 10:
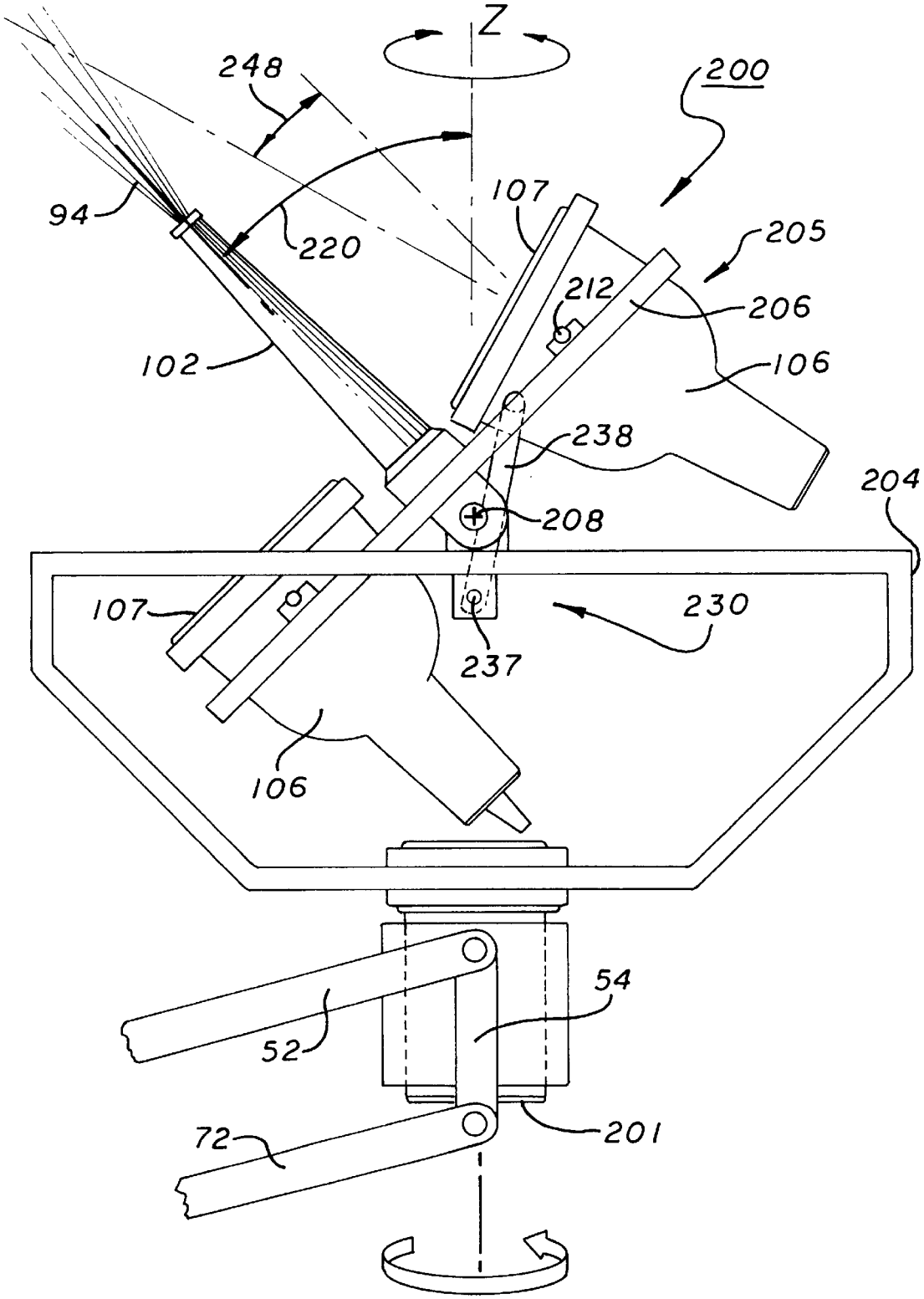
FIG. 10 is a side view of a still further alternate embodiment of water display schematically illustrating the movement of the nozzle.

FIG. 10 is a side view of water display 200 showing the movement of nozzle 102. From the performance position shown in FIG. 8, yaw motor 201 of FIG. 10 permits controlled movement of nozzle 102 about the Z-axis as gimbal 205 permits controlled movement of nozzle 102 from its vertical orientation in an angular direction. Horizontal motor 214 of FIG. 9 controllably rotates gimbal 206 of FIG. 10 through horizontal axis 208. The combination of the rotational movement from yaw motor 201 and the angular movement from horizontal motor 214 aims the stream of water 94 so that the stream of water 94 may be directed at any location about the Z-axis and at an angle 220 relative to the Z-axis. In a typical embodiment, nozzle 102 may rotate plus or minus three hundred sixty degrees (±360°) about the Z-axis and will rotate plus or minus sixty degrees (±60°) about horizontal axis 208 without use of slip rings or a rotating pipe coupling, the computer program purposely limiting the commanded angles appropriately. Obviously slip rings and a rotating pipe coupling can be used if desired to provide full angular freedom about the Z axis.

By combining the rotational movement as controlled through yaw motor 201 of FIG. 10, the angular movement as controlled through horizontal motor 214 of FIG. 9, and the variable water flow through nozzle 102 as controlled through pump 80 of FIG. 8, computer 20 can be used to specify completely the location of the stream of water 94 and to manipulate the stream of water 94 into a most pleasing, expressive water display.

As shown in FIG. 9, four lamps 106 are attached to gimbal 206, two rigidly and two through pins 212. The two rigidly mounted lamps will follow the nozzle orientation to illuminate the water flow approximately aligned with the axis of the nozzle. However due to the force of gravity, the stream of water 94 of FIG. 10 will arc when originating at an angle 220 that is greater than zero degrees from the Z-axis. When nozzle 102 is deflected substantially from vertical, the stream of water 94 will arc out of the light beams emanating from the two rigidly mounted lamps 106 during night time water displays. To maintain the light beams emanating from some of lamps 106 on the stream of water 94 over a greater distance, a mechanism such as linkage 230 may be provided.

As shown in FIG. 8, link 238 pivotally mounts at end 240 on pin 246 attached to a lamp assembly, and at the other end on pin 237 mounted rigidly with respect to gimbal 204. As nozzle 102 is deflected from the Z-axis at angle 220 as illustrated in FIG. 10, link 238 causes the respective lamp to rotate through a larger angle than the angle 220, such as an additional angle 248, causing the beam from the lamp to illuminate a distal part of the stream as it curves away from the illumination of the rigidly mounted lamps. With two diametrically disposed lamps rigidly mounted to gimbal 206 and the other two diametrically pivotally disposed lamps mounted as described, the light beams emanating from lamps 106 may be maintained on the stream of water 94 over a greater distance to illuminate a greater length of the stream before water 94 falls into the darkness of night.

Figure 11:
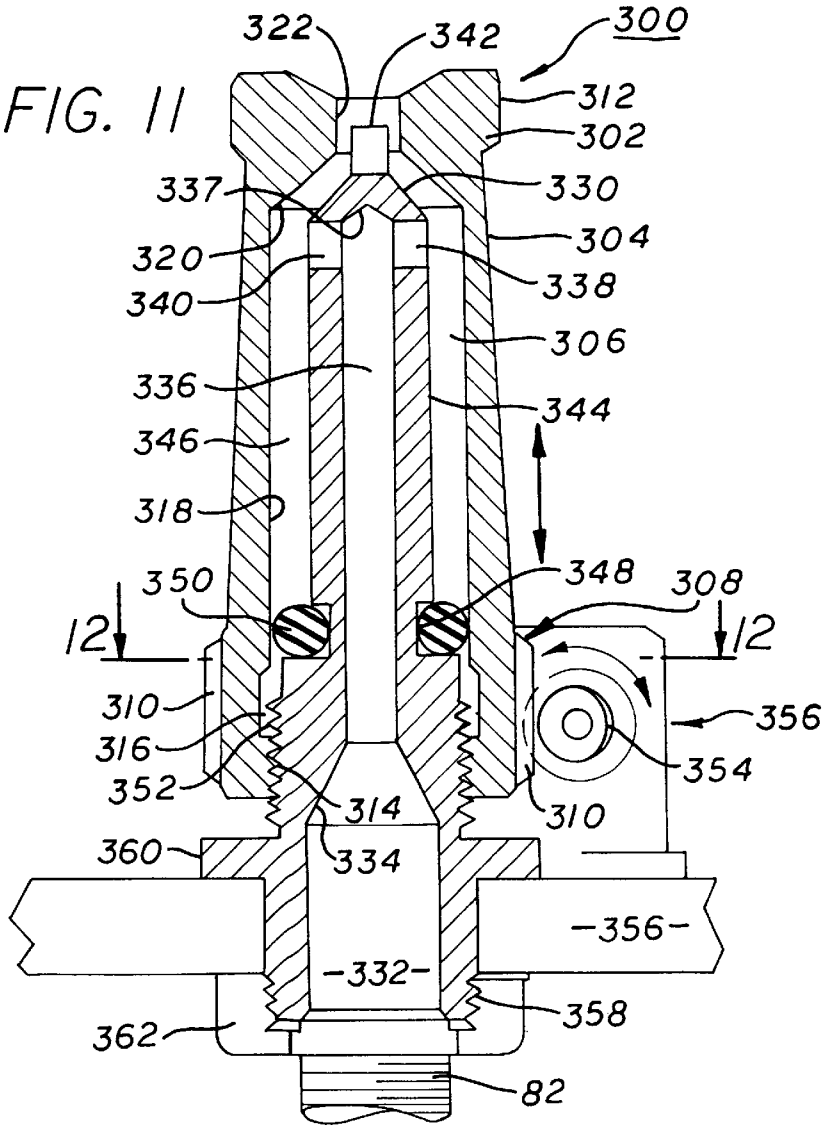
FIG. 11 is a sectional view of an embodiment of the nozzle of the invention providing variable control.

Preferably, nozzle 102 of FIG. 1 may be a fire hose-type nozzle, although any water display nozzle, or a plurality of nozzles for regulating and directing a flow of fluid, fixed or variable, may be used. By way of but one example of a variable nozzle, FIG. 11 is a section view of an embodiment of the nozzle of the invention providing variable control. Nozzle 300 may be comprised of housing 302, water guide 330, seal 350, worm screw 354, and associated hardware. Housing 302 may be comprised of cylinder 304, the inside of which forms internal chamber 306. The lower portion of cylinder 304 may be formed into worm wheel 308 having marginal teeth 310. From worm wheel 308, cylinder 304 tapers externally into lip 312. Internal chamber 306 may be an elongated chamber into which may be formed internal mating threads 314 at the base of internal chamber 306. Above the upper end of internal mating threads 314 may be cavity 316, whose end forms the beginning of elongated portion 318. Elongated portion 318 ends in convergent cone 320. Convergent cone 320 tapers into nozzle exit area 322. Inserted into housing 302 may be water guide 330. From cylindrical inlet 332, the interior of water guide 330 forms convergent cone 334. From convergent cone 334, throat 336 extends to strike plate 337. Just below strike plate 337, vent hole 338 and vent hole 340 extend through the thickness of water guide 330. The shape of strike plate 337 may be conical to better divert inlet water towards vent hole 338 and vent hole 340.

Above and external to strike plate 337 may be post 342. From post 342, water guide 330 tapers outward into elongated cylinder 344. When water guide 330 is inserted into housing 302, post 342 resides concentric to nozzle exit area 322 and elongated cylinder 344 resides concentric to elongated portion 318. Elongated cylinder 344 and elongated portion 318 form cavity 346 into which water flows from vent hole 338 and vent hole 340. To accept a seal at one end of the union between water guide 330 and housing 302, grove 348 may be formed into elongated cylinder 344 at the base of elongated cylinder 344. Prior to inserting water guide 330 into housing 302, seal 350 may be placed into grove 348. Preferably, seal 350 may be an o-ring.

By moving post 342 relative to nozzle exit area 322, the stream of water 94 (shown in FIG. 1) may be adjusted from a round stream to a fan shaped stream. To accomplish this, external mating threads 352 are formed below grove 348 of water guide 330. Internal mating threads 314 of housing 302 are designed to mate with and move in relationship to external mating threads 352 of water guide 330. To rotate internal mating threads 314 of housing 302, worm screw 354 may be fixed to support plate 356 and coupled to marginal teeth 310. Worm wheel 308 and worm screw 354 form worm gear 356. Worm gear 356 is discussed below in connection with FIG. 12.

To attach nozzle 300 to the water display of the present invention, threaded portion 358 of nozzle 300 may be inserted through support plate 356 so that seat 360 rests against the top of support plate 356. Coupling nut 362 engages flexible hose 82 to cylindrical inlet 332 and clamps nozzle 300 to support plate 356 by engaging threaded portion 358.

Figure 12:
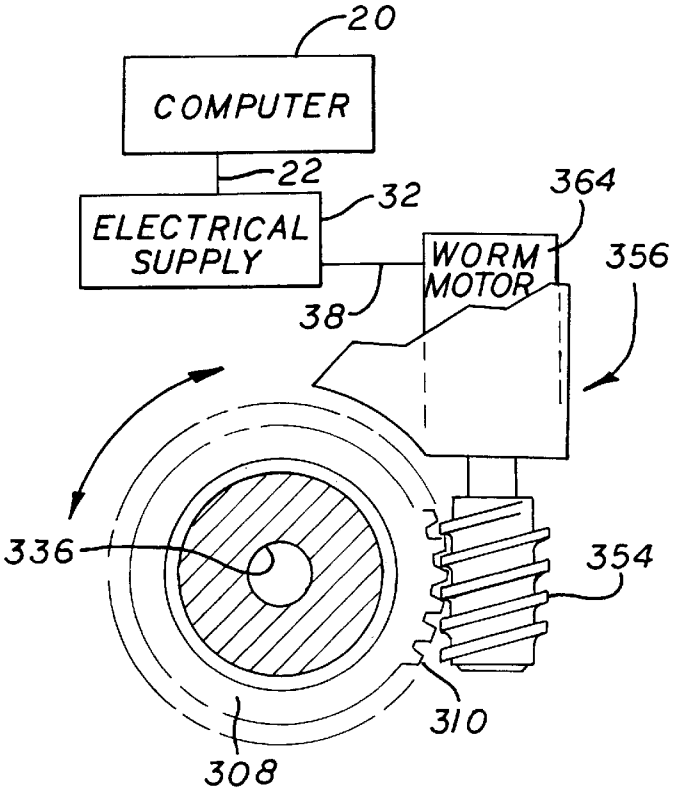
FIG. 12 is fragmented sectional view of the worm gear of the nozzle taken generally off of line 12—12 of FIG. 11.

In operation, worm gear 356 moves housing 302 up or down in the direction of the arrow shown in FIG. 11. The operation of worm gear 356 may be better understood in connection with FIG. 12. FIG. 12 is fragmented sectional view of worm gear 356 of nozzle 300 taken generally off of line 12—12 of FIG. 11. As shown in FIG. 12, worm gear 356 may be comprised of worm wheel 308 having marginal teeth 310 that mesh into a threaded shaft that forms worm screw 354. On a signal received from computer 20 through communication links 22, electrical supply 32 sends electricity to worm motor 364 through electrical lines 38. Worm motor 364, being coupled to worm screw 354, rotates worm screw 354 responsive to the signal from computer 20.

Many other variable nozzles may also be used if desired, as the present invention is not limited to use with any specific nozzle or nozzles, or number or type of lighting assemblies. By way of example only, the lighting assemblies could include controllable color wheels controlled by the computer, or contain different colors, with the lamps be independently and variably operable to vary the color of the lighting, and/or have differently shaped beams so as to fade from one shape beam to another. Obviously the range of variations in the present invention is only limited by the imagination of the implementer, given the disclosure provided herein.

While the present invention has been particularly described with reference to the various Figures, it should be understood that the Figures and detailed description, and the identification of certain preferred and alternate materials, are for illustration only and should not be taken as limiting the scope of the invention or excluding still other alternatives. Many changes and modifications may be made to the invention, by one having ordinary skill in the art, without departing from the matter and scope of the invention.

What is claimed is:

1. A decorative water display comprising:

an inner gimbal;

a roll motor coupled to the inner gimbal;

an outer gimbal rotatably supporting the inner gimbal;

a pitch motor coupled to the outer gimbal;

a controller controlling the roll and pitch motors;

a first lamp coupled to the inner gimbal;

a nozzle coupled to the inner gimbal; and a source of pressurized water coupled to the nozzle.

2. The decorative water display of claim 1, the decorative water display further comprising a frame rotatable supporting the outer gimbal and an elevating mechanism coupled to the frame, the elevating mechanism adjusting an elevation of the frame.

3. The decorative water display of claim 1, wherein the first lamp moves to a first angle from the vertical as the nozzle moves to a second angle from the vertical where the first angle is greater than the second angle.

4. The decorative water display of claim 3 wherein the nozzle is pivotally coupled to the inner gimbal, the decorative water display further comprising a tracking link having a first end and a second end, the tracking link pivotally mounted to the nozzle at the first end and pivotally mounted to a pin mounted rigidly with respect to the direction of pivotal motion of the nozzle at the second end.

5. The decorative water display of claim 3 wherein the first lamp is pivotally coupled to the inner gimbal, the decorative water display further comprising a tracking link having a first end and a second end, the tracking link pivotally mounted to the first lamp at the first end and pivotally mounted to a pin mounted rigidly with respect to the direction of pivotal motion of the first lamp at the second end.

6. The decorative water display of claim 3, the decorative water display further comprising a second lamp rigidly coupled to the inner gimbal such that as the nozzle moves to the second angle from the vertical the second lamp moves to the second angle from the vertical.

7. The decorative water display of claim 2, wherein the elevating mechanism further comprises:

a support structure;

a lever, the lever having a first end, a length, and a point along the length, the lever coupled to the frame at the first end of the lever and pivotally coupled to the support structure at the point along the length of the lever.

8. The decorative water display of claim 7, the lever having a second end, the elevating mechanism further comprising an actuator having a first end and a second end, the first end of the actuator being coupled to the second end of the lever, the second end of the actuator being coupled to the support structure, wherein the actuator moves the second end of the lever to a first position and a second position responsive to a control signal thereby adjusting the elevation of the frame to a first elevation and a second elevation.

9. The decorative water display of claim 8 wherein the actuator further moves the second end of the lever to a third position responsive to the control signal thereby adjusting the elevation of the frame to a third elevation.

10. The decorative water display of claim 7 wherein the support structure is fixed to the ground.

11. The decorative water display of claim 7, the elevating mechanism further comprising a stabilizing link having a first end and a second end, wherein the first end of the lever is pivotally coupled to a first point on the frame, the first end of the stabilizing link is pivotally coupled to a second point on the frame, and the second end of the stabilizing link is pivotally coupled to the support structure, such that the frame, the lever, the support structure, and the stabilizing link form a parallelogram linkage that maintains the frame in a fixed orientation relative to the support structure.

12. The decorative water display of claim 1 wherein the nozzle comprises a water guide, a housing disposed about the water guide, and a spray adjuster coupled to the water guide and the housing, to move the water guide relative to the housing.

13. The decorative water display of claim 12 wherein the nozzle is a fire hose nozzle.

14. The decorative water display of claim 2 further comprising controllable auxiliary services coupled to at least one of the controller and the elevating mechanism, wherein the auxiliary services comprises at least one of electricity, air, and water.

15. The decorative water display of claim 12 wherein the spray adjuster further comprises a threaded coupling that adjustably couples the water guide and the housing, a worm screw mechanism that rotates the threaded coupling to move the water guide relative to the housing, and a worm screw motor coupled to the worm screw mechanism to motivate the worm screw mechanism.

16. A decorative water display comprising:

a gimbal;

a roll motor coupled to the gimbal;

a nozzle coupled to the gimbal;

a source of pressurized water coupled to the nozzle;

a rotatable frame pivotally supporting the gimbal;

a yaw motor coupled to the frame;

a controller controlling the roll and yaw motors; and a first lamp coupled to the gimbal.

17. The decorative water display of claim 16, the decorative water display further comprising an elevating mechanism coupled to the yaw motor, the elevating mechanism thereby adjusting an elevation of the frame.

18. The decorative water display of claim 16, wherein the first lamp moves to a first angle from the vertical as the nozzle moves to a second angle from the vertical where the first angle is greater than the second angle.

19. The decorative water display of claim 18 wherein the nozzle is pivotally coupled to the gimbal, the decorative water display further comprising a tracking link having a first end and a second end, the tracking link pivotally mounted to the nozzle at the first end and pivotally mounted to a pin mounted rigidly with respect to the direction of pivotal motion of the nozzle at the second end.

20. The decorative water display of claim 18 wherein the first lamp is pivotally coupled to the gimbal, the decorative water display further comprising a tracking link having a first end and a second end, the tracking link pivotally mounted to the first lamp at the first end and pivotally mounted to a pin mounted rigidly with respect to the direction of pivotal motion of the first lamp at the second end.

21. The decorative water display of claim 18, the decorative water display further comprising a second lamp rigidly coupled to the gimbal such that as the nozzle moves to the second angle from the vertical the second lamp moves to the second angle from the vertical.

22. The decorative water display of claim 17, wherein the elevating mechanism further comprises:

a support structure;

a lever, the lever having a first end, a length, and a point along the length, the lever coupled to the yaw motor at the first end of the lever and pivotally coupled to the support structure at the point along the length of the lever.

23. The decorative water display of claim 22, the lever having a second end, the elevating mechanism further comprising an actuator having a first end and a second end, the first end of the actuator being coupled to the second end of the lever, the second end of the actuator being coupled to the support structure, wherein the actuator moves the second end of the lever to a first position and a second position responsive to a control signal thereby adjusting the elevation of the frame to a first elevation and a second elevation.

24. The decorative water display of claim 23 wherein the actuator further moves the second end of the lever to a third position responsive to the control signal thereby adjusting the elevation of the frame to a third elevation.

25. The decorative water display of claim 22 wherein the support structure is fixed to the ground.

26. The decorative water display of claim 22, the elevating mechanism further comprising a stabilizing link having a first end and a second end, wherein the first end of the lever is pivotally coupled to a first point on the yaw motor, the first end of the stabilizing link is pivotally coupled to a second point on the yaw motor, and the second end of the stabilizing link is pivotally coupled to the support structure, such that the yaw motor, the lever, the support structure, and the stabilizing link form a parallelogram linkage that maintains the yaw motor in a fixed orientation relative to the support structure.

27. The decorative water display of claim 16 wherein the nozzle comprises a water guide, a housing disposed about the water guide, and a spray adjuster coupled to the water guide and the housing, to move the water guide relative to the housing.

28. The decorative water display of claim 27 wherein the nozzle is a fire hose nozzle.

29. The decorative water display of claim 17 further comprising controllable auxiliary services coupled to at least one of the controller and the elevating mechanism, wherein the auxiliary services comprises at least one of electricity, air, and water.

30. The decorative water display of claim 27 wherein the spray adjuster further comprises a threaded coupling that adjustably couples the water guide and the housing, a worm screw mechanism that rotates the threaded coupling to move the water guide relative to the housing, and a worm screw motor coupled to the worm screw mechanism to motivate the worm screw mechanism.

31. The decorative water display of claim 1 wherein the source of pressurized water is a pump.

32. The decorative water display of claim 1 wherein the source of pressurized water is a controllable variable frequency pump.

33. The decorative water display of claim 1 wherein at least one of the roll motor and the pitch motor are sealed electrical servo motors.

34. The decorative water display of claim 16 wherein the source of pressurized water is a pump.

35. The decorative water display of claim 16 wherein the source of pressurized water is a controllable variable frequency pump.

36. The decorative water display of claim 16 wherein at least one of the roll motor and the pitch motor are sealed electrical servo motors.

37. A decorative water display comprising:

a nozzle;

a source of pressurized water coupled to the nozzle;

a first lamp;

a gimbal assembly having a first axis of rotation and a second axis of rotation, the second axis being substantially perpendicular to the first axis, the gimbal assembly movably supporting the nozzle and the first lamp;

a first drive system coupled to the gimbal assembly to rotate a first portion of the gimbal assembly, the nozzle, and the first lamp about the first axis;

a second drive system coupled to the gimbal assembly to rotate a second portion of the gimbal assembly, the nozzle, and the first lamp about the second axis; and a controller controlling the first and second drive systems.

38. The decorative water display of claim 37 wherein the first axis and the second axis are substantially horizontal.

39. The decorative water display of claim 37 wherein the first axis is substantially horizontal and the second axis is substantially vertical.

40. The decorative water display of claim 37, wherein the first lamp moves to a first angle from the vertical as the nozzle moves to a second angle from the vertical where the first angle is greater than the second angle.

41. The decorative water display of claim 40, wherein the nozzle is pivotally coupled to the gimbal assembly, the decorative water display further comprising a tracking link having a first end and a second end, the tracking link pivotally mounted to the nozzle at the first end and pivotally mounted to a pin mounted rigidly with respect to the direction of pivotal motion of the nozzle at the second end.

42. The decorative water display of claim 40, wherein the first lamp is pivotally coupled to the gimbal assembly, the decorative water display further comprising a tracking link having a first end and a second end, the tracking link pivotally mounted to the first lamp at the first end and pivotally mounted to a pin mounted rigidly with respect to the direction of pivotal motion of the first lamp at the second end.

43. The decorative water display of claim 40, the decorative water display further comprising a second lamp rigidly coupled to the gimbal assembly such that as the nozzle moves to the second angle from the vertical the second lamp moves to the second angle from the vertical.

44. The decorative water display of claim 37, the decorative water display further comprising an elevating mechanism coupled to the gimbal assembly, the elevating mechanism adjusting an elevation of the gimbal assembly.

45. The decorative water display of claim 44 further comprising controllable auxiliary services coupled to at least one of the controller and the elevating mechanism, wherein the auxiliary services comprises at least one of electricity, air, and water.

46. The decorative water display of claim 44, wherein the elevating mechanism further comprises:

a support structure;

a lever, the lever having a first end, a length, and a point along the length, the lever coupled to the gimbal assembly at the first e nd of the lever and pivotally coupled to the support structure at the point along the length of the lever.

47. The decorative water display of claim 46 wherein the support structure is fixed to the ground.

48. The decorative water display of claim 46, the elevating mechanism further comprising a stabilizing link having a first end and a second end, wherein the first end of the lever is pivotally coupled to a first point on the gimbal assembly, the first end of the stabilizing link is pivotally coupled to a second point on the gimbal assembly, and the second end of the stabilizing link is pivotally coupled to the support structure, such that the frame, the lever, the support structure, and the stabilizing link form a parallelogram linkage that maintains the gimbal assembly in a fixed orientation relative to the support structure.

49. The decorative water display of claim 48, the lever having a second end, the elevating mechanism further comprising an actuator having a first end and a second end, the first end of the actuator being coupled to the second end of the lever, the second end of the actuator being coupled to the support structure, wherein the actuator moves the second end of the lever to a first position and a second position responsive to a control signal thereby adjusting the elevation of the gimbal assembly to a first elevation and a second elevation.

50. The decorative water display of claim 49, wherein the actuator further moves the second end of the lever to a third position responsive to the control signal thereby adjusting the elevation of the gimbal assembly to a third elevation.

51. The decorative water display of claim 37, wherein the nozzle comprises a water guide, a housing disposed about the water guide, and a spray adjuster coupled to the water guide and the housing, to move the water guide relative to the housing.

52. The decorative water display of claim 51 wherein the nozzle is a fire hose nozzle.

53. The decorative water display of claim 51 wherein the spray adjuster further comprises a threaded coupling that adjustably couples the water guide and the housing, a worm screw mechanism that rotates the threaded coupling to move the water guide relative to the housing, and a controllable motor coupled to the worm screw mechanism to motivate the worm screw mechanism.

54. The decorative water display of claim 37 wherein the source of pressurized water is a pump.

55. The decorative water display of claim 37 wherein the source of pressurized water is a controllable variable frequency pump.

56. The decorative water display of claim 37 wherein at least one of the first drive system and the second drive system are sealed electrical servo motors.

57. A decorative water display comprising:

a nozzle;

a source of pressurized water coupled to the nozzle;

a first lamp;

a gimbal assembly having a first axis of rotation and a second axis of rotation, the second axis being substantially perpendicular to the first axis, the gimbal assembly movably supporting the nozzle and the first lamp;

a first electrical servo motor coupled to the gimbal assembly to rotate a first portion of the gimbal assembly, the nozzle, and the first lamp about the first axis;

a second electrical servo motor coupled to the gimbal assembly to rotate a second portion of the gimbal assembly, the nozzle, and the first lamp about the second axis; and a controller controlling the first and second electrical servo motors.

58. The decorative water display of claim 57 wherein the first axis and the second axis are substantially horizontal.

59. The decorative water display of claim 57 wherein the first axis is substantially horizontal and the second axis is substantially vertical.

60. The decorative water display of claim 57, wherein the first lamp moves to a first angle from the vertical as the nozzle moves to a second angle from the vertical where the first angle is greater than the second angle.

61. The decorative water display of claim 60, wherein the nozzle is pivotally coupled to the gimbal assembly, the decorative water display further comprising a tracking link having a first end and a second end, the tracking link pivotally mounted to the nozzle at the first end and pivotally mounted to a pin mounted rigidly with respect to the direction of pivotal motion of the nozzle at the second end.

62. The decorative water display of claim 60, wherein the first lamp is pivotally coupled to the gimbal assembly, the decorative water display further comprising a tracking link having a first end and a second end, the tracking link pivotally mounted to the first lamp at the first end and pivotally mounted to a pin mounted rigidly with respect to the direction of pivotal motion of the first lamp at the second end.

63. The decorative water display of claim 60, the decorative water display further comprising a second lamp rigidly coupled to the gimbal assembly such that as the nozzle moves to the second angle from the vertical the second lamp moves to the second angle from the vertical.

64. The decorative water display of claim 57, the decorative water display further comprising an elevating mechanism coupled to the gimbal assembly, the elevating mechanism adjusting an elevation of the gimbal assembly.

65. The decorative water display of claim 64 further comprising controllable auxiliary services coupled to at least one of the controller and the elevating mechanism, wherein the auxiliary services comprises at least one of electricity, air, and water.

66. The decorative water display of claim 64, wherein the elevating mechanism further comprises:

a support structure;

a lever, the lever having a first end, a length, and a point along the length, the lever coupled to the gimbal assembly at the first end of the lever and pivotally coupled to the support structure at the point along the length of the lever.

67. The decorative water display of claim 66 wherein the support structure is fixed to the ground.

68. The decorative water display of claim 66, the elevating mechanism further comprising a stabilizing link having a first end and a second end, wherein the first end of the lever is pivotally coupled to a first point on the gimbal assembly, the first end of the stabilizing link is pivotally coupled to a second point on the gimbal assembly, and the second end of the stabilizing link is pivotally coupled to the support structure, such that the frame, the lever, the support structure, and the stabilizing link form a parallelogram linkage that maintains the gimbal assembly in a fixed orientation relative to the support structure.

69. The decorative water display of claim 66, the lever having a second end, the elevating mechanism further comprising an actuator having a first end and a second end, the first end of the actuator being coupled to the second end of the lever, the second end of the actuator being coupled to the support structure, wherein the actuator moves the second end of the lever to a first position and a second position responsive to a control signal thereby adjusting the elevation of the gimbal assembly to a first elevation and a second elevation.

70. The decorative water display of claim 69, wherein the actuator further moves the second end of the lever to a third position responsive to the control signal thereby adjusting the elevation of the gimbal assembly to a third elevation.

71. The decorative water display of claim 57, wherein the nozzle comprises a water guide, a housing disposed about the water guide, and a spray adjuster coupled to the water guide and the housing, to move the water guide relative to the housing.

72. The decorative water display of claim 71 wherein the nozzle is a fire hose nozzle.

73. The decorative water display of claim 71 wherein the spray adjuster further comprises a threaded coupling that adjustably couples the water guide and the housing, a worm screw mechanism that rotates the threaded coupling to move the water guide relative to the housing, and a controllable electric servo motor coupled to the worm screw mechanism to motivate the worm screw mechanism.

74. The decorative water display of claim 57 wherein the source of pressurized water is a pump.

75. The decorative water display of claim 57 wherein the source of pressurized water is a controllable variable frequency pump.

* * * * *